United States Patent [19]

Rebsch

[11] 4,131,790

[45] Dec. 26, 1978

[54] BIORHYTHM INDICATOR

[76] Inventor: Donald L. Rebsch, 14016 Shippers La., Rockville, Md. 20853

[21] Appl. No.: 788,435

[22] Filed: Apr. 18, 1977

[51] Int. Cl.[2] ..... G06C 3/00

[52] U.S. Cl. ..... 235/89 R; 40/107; 235/85 FC

[58] Field of Search ..... 235/89 R, 85 R, 85 FC; 346/49; 40/107, 110

[56] References Cited

U.S. PATENT DOCUMENTS

| | | | |
|---|---|---|---|
| 2,243,729 | 5/1941 | Ellis | 346/49 |
| 3,253,780 | 5/1966 | Stewart et al. | 235/78 R |
| 3,625,418 | 12/1971 | Colon | 235/89 R |
| 3,709,430 | 1/1973 | Matthews | 235/109 |
| 4,035,616 | 7/1977 | Piringer | 235/78 RC |

FOREIGN PATENT DOCUMENTS

| | | | |
|---|---|---|---|
| 339758 | 9/1959 | Switzerland | 235/89 R |

*Primary Examiner*—Stephen J. Tomsky
*Attorney, Agent, or Firm*—Beall & Jeffery

[57] ABSTRACT

The 23 day physical biorhythmic cycle, 28 day sensitive biorhythmic cycle, and 33 day intellectual biorhythmic cycle are commonly plotted in phase relationship with each other from a point where they commonly start on the neutral axis representing birth through 100 years in 4 year groupings, with adjacent 4 year groupings being shifted 1 day corresponding to the presence of a leap year in each 4 year grouping. The chart containing the plots is provided with lines indicating day intervals and indicia representing year intervals consecutively from the beginning day of birth. A curve that is a composite of the three biorhythmic curves is vertically aligned and spaced adjacently throughout the chart. A table of consecutively numbered days for specific years with the presence or absence of February 29 in the particular years being compensated for, is also provided so that it may be placed adjacent the plots to align the birthday as indicated by day, month and year on the table with the birthday mark as indicated on the plot, with a shift of one day on the plot according to whether February 29 occurred before or after the birthday within the four year grouping.

11 Claims, 5 Drawing Figures

24
14
28
30
29
40

Use this Label for
12-MONTH RULER
40
41
42
43
44
45
46
47
48
49
50
51

44,46

BIORHYTHM INDICATOR

BACKGROUND OF THE INVENTION

In 1729, DeMairan discovered that a bean plant would continue to spread its leaves every 24 hours to collect sunlight, even if placed in complete darkness and therefore theorized that there was an internal clock or biorhythm. Biorhythm observations go back even further, at least to Hippociates, but it was in the 1900's that most research has been accomplished.

Research and observations have tended to show that most people observed have a physical cycle of 23 days wherein a person's bodily strength increases from average to a peak, decreases back to average, decreases to a low, and thereafter increases to the average to complete the cycle in the 23 day period. Also, a 28 day sensitive cycle has been observed, wherein the mood of the individual goes through the same cycle as that of the physical cycle, but in a 28 day period. The third observed cycle is that of the mental cycle relating to the thought powers of the individual, and this varies in the same manner as the other two cycles, but for a 33 day period. Each of these cycles appears to begin at the average or neutral axis at the time of birth and increase to their peak. With the periods of the three cycles remaining fixed at 23 days, 28 days and 33 days respectively, theoretically for each person at a specific number of days from birth, the phase of the three cycles should be identical, and some research has appeared to verify this.

There has been a considerable amount of research conducted with respect to observing the characteristics of individuals when the three cycles appear to be in their positive phase simultaneously, when one or more cycles cross the neutral axis or average line on the same day, and the like characteristic points of the curves.

The three cycles have been defined in different ways and described by different terms, and although three specific terms are used in this specification, including claims, it is to be understood that they are interchangeable with the equivalent terminology. For example, the physical cycle refers to manual labor, endurance, strength and health. The sensitive cycle, also known as the emotional cycle, appears to particularly effect supervision, teaching, decisions, business, entertainment, contacting people, and love. The intellectual cycle, also known as the mental cycle, particularly effects an individual's study, calculation, plans and conferences.

There is a particular need to further verify the research that has already been conducted to determine its validity, extent of influence upon the average person's behavior, and to perhaps anticipate your natural tendencies for any particular day to take into consideration the extent that the effects of the environment may have upon you for such day.

Various devices have been used to correlate one or more of these cycles with a particular person's specific birth and a current calendar. A sliding card calculator, a rotating circular calculator, a hand crank calculator, and an electronic calculator are all known. Further, computers have recently been used to print out or plot the biorhythm cycles for a specific person in correlation with the calendar. However, such devices suffer from one or more of the following disadvantages: they can only be used or set up by highly trained individuals; they require a considerable amount of calculation and interpretation; there is a large chance of numerous errors; they are difficult to read after set-up; or they are so expensive that they cannot readily be adopted by the general public.

In addition to biorhythmic calculators, a large number of calculators or information providing devices have been used in a wide variety of fields, such as in determining the menstrual cycles or fertility periods for females. An example of such a patent is U.S. Pat. No. 3,625,418, patented Dec. 7, 1971.

Although the exact configuration of the curves associated with the biorhythm cycles is not known, it is generally assumed or at least represented by a sine curve, and sine curves or sine waves are the basis for a mathematical calculation of motion, sound, electricity, radio waves and light, so that it appears fundamentally sound to employ a sine wave with respect to a biological rhythm.

SUMMARY

It is an object of the present invention to provide a device that may be used to represent the three biorhythm cycles in correlation with the calendar for a specific individual, such that it may be easily assembled for the specific individual and easily read primarily as an aid in conducting research into the presence or absence of biorhythmic cycles, and any effect they may have upon a person's daily life.

At regular intervals along the chart, the cumulative or total number of days since birth appear in association with the vertical line representing such a day. The three characteristic curves are provided with different line symbols differentiated between them, and further symbols are used with respect to the composite curve to indicate various characteristics.

BRIEF DESCRIPTION OF THE DRAWINGS

Further objects, features, and advantages of the present invention will become more clear from the following description of the drawing, wherein.

DETAILED DESCRIPTION OF A PREFERRED EMBODIMENT

Figure 1:
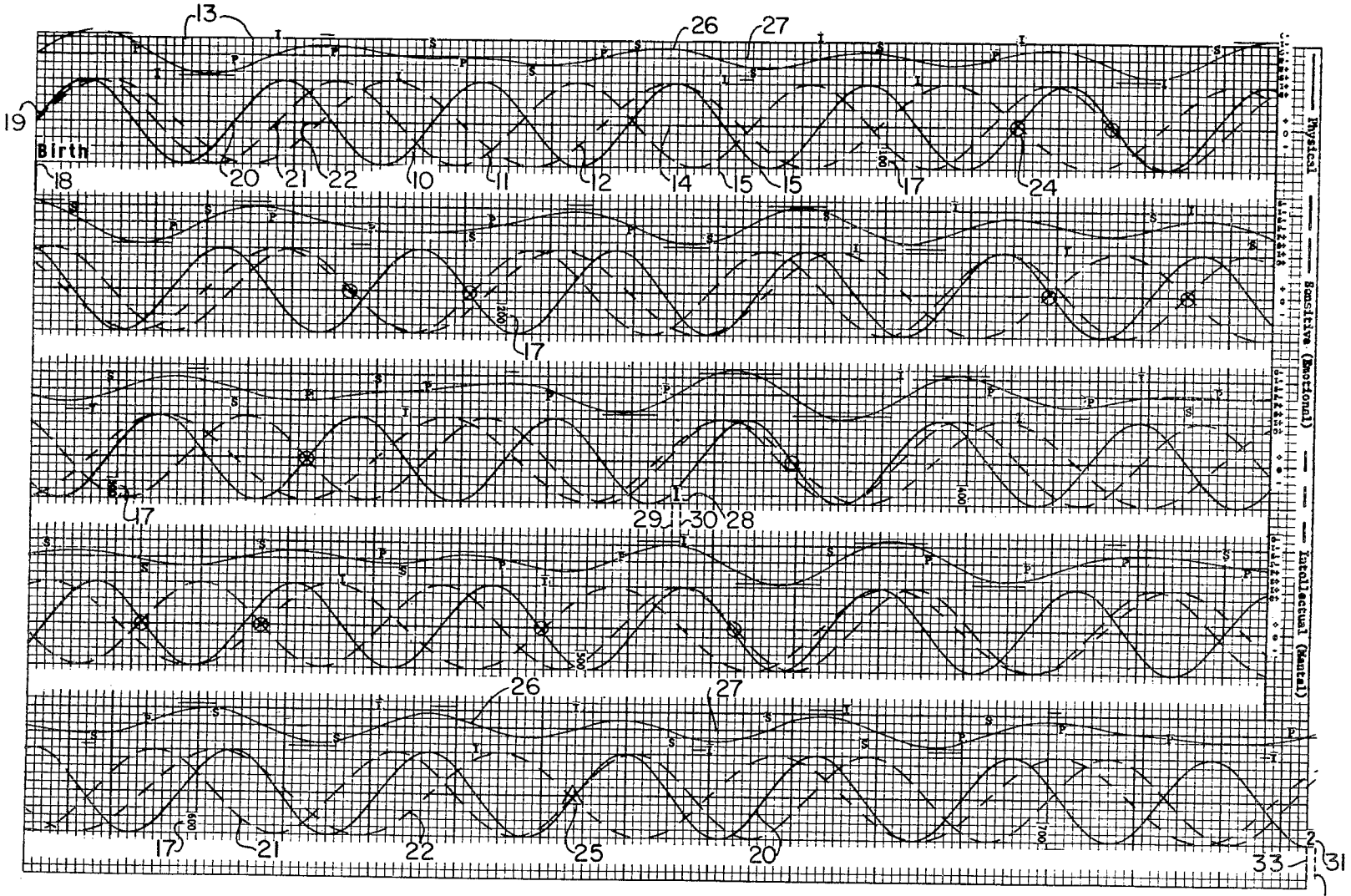
FIG. 1 and FIG. 2, when combined, show a four year interval of biorhythm cycles starting from birth, constructed according to the present invention.
Figure 2:
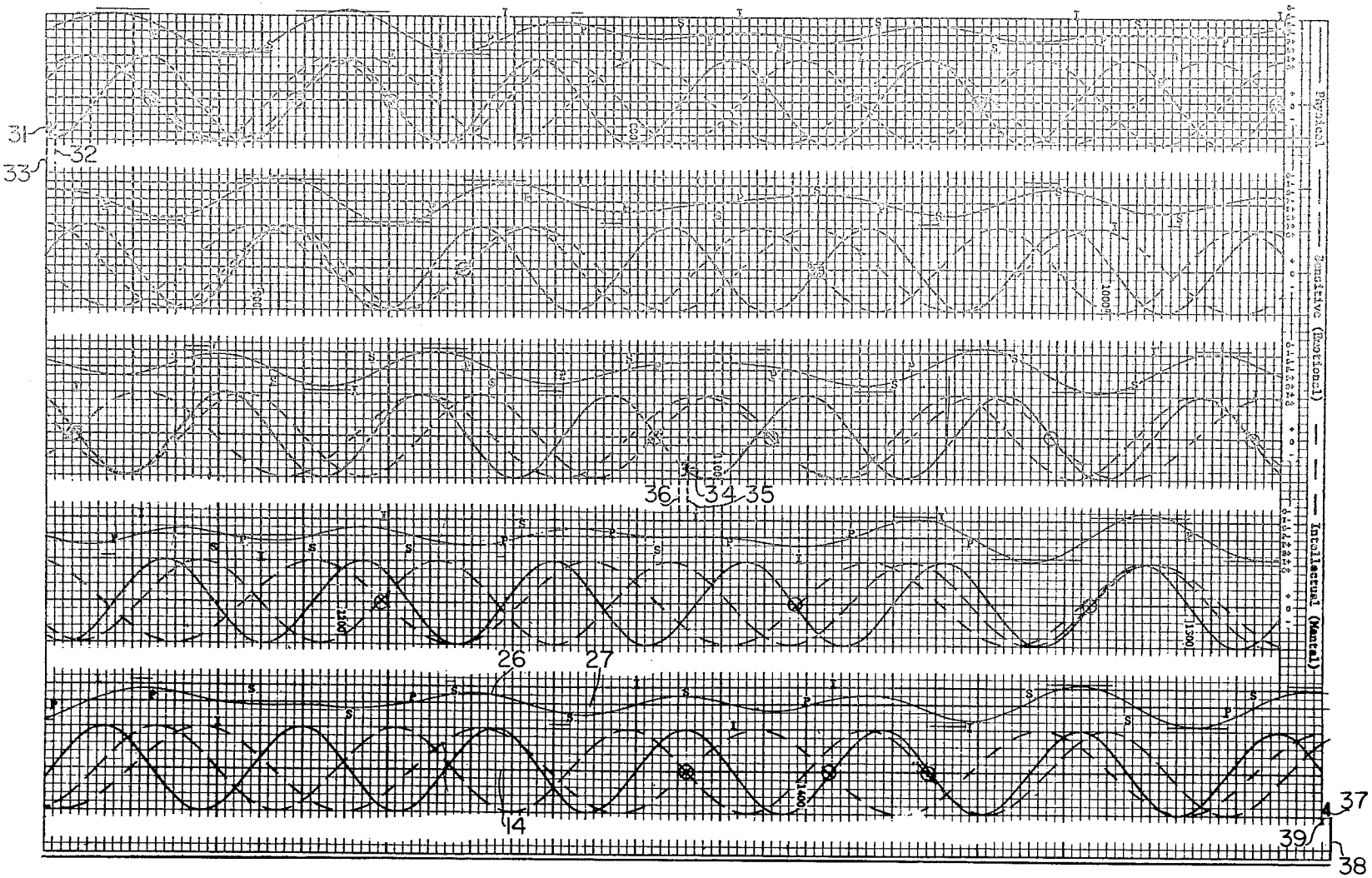

The present invention is particularly adapted to be used in a book, or booklet form, wherein the three biorhythmic cycles of physical, sensitive, and intellectual are plotted from birth for a substantial period of time, such as 100 years. FIGS. 1 and 2 respectively represent two pages from such a book or booklet, with such pages preferrably facing each other so that when the book or booklet is opened, the pages will present a generally common plane having therein the biorhythmic cycles plotted for a 4 year period. The 4 year period represented in FIGS. 1 and 2 is the period from birth through the fourth year of life, and with an explanation of these four years, it can readily be seen that the remaining years of a total 100 year period or any other total period may be easily plotted in the same manner. In FIGS. 1 and 2, the physical cycle of 23 days is plotted by a solid line 10, the sensitive cycle of 28 days is plotted as a long dashed line 11, and the intellectual cycle of 33 days is plotted as a short dashed line 12. The chart or graph includes a plurality of equally spaced and parallel vertical reference lines 13, with the space between adjacent lines representing a time period of 1 day. A horizontal reference line 14 represents the average for the three biorhythmic cycles 10, 11, 12, and the area above the reference line 14 corresponds to a positive or strong biorhythmic cycle influence, while the area below such reference line 14 corresponds to a low or weak biorhythmic cycle influence. The biorhythmic cycles are plotted as sine curves, since such appear to be most commonly employed in nature, although the exact shape of such curves is unknown and also their amplitude would vary in actuality; the precise sine curve for the three cycles with equal amplitude is chosen for illustrative purposes and is the best approximation available to fit experimentally obtained data. For every five days as represented by the vertical reference lines 13, a darker line 15 is used merely for ease of calculations. Periodically, indicia 17 are provided to indicate the total number of days counting from the beginning reference mark 18.

According to present biorhythmic theories and experimental data, all three biorhythmic cycles 10, 11 and 12 start at the intersection of the horizontal average reference line 14 and the beginning vertical reference line 18, and from there increase. Such intersection point 19 appears to correspond to the birth of a particular individual. With the biorhythmic cycles 10, 11, 12 each being for a fixed period of time, it is seen that the plot or graph of such cycles will theoretically be the same for all individuals on the same number of days counted from birth. Some experimental data has tended to support this theory. The present chart is designed to be useful in providing a part of the biorhythmic cycles for any particular individual as correlated with any specific day, month, and year with easy and quick reference to facilitate further research and observations by a larger group of people than have heretofore been involved.

The intersection points 20, 21 and 22 respectively between the plots 10, 11, 12 of the biorhythmic cycles and the horizontal average reference line 14 have been observed by some researchers to be critical days wherein the body is in a state of change, and in the present chart specific symbols, such as symbol 24 have been used to indicate where two such critical points occur within the same day, and 25 where three such critical points occur within the same day. The indication of these critical days, double critical days, and triple critical days, respectively should assist further research.

Immediately above the curves 10, 11, 12, there is a compositive curve 26 that oscillates about the average horizontal line 27, and is a composite of the vertically aligned portions of the curves 10, 11, 12. This composite curve 26 takes into consideration the combined effect of the three basic biorhythmic cycles, and should also be useful in conducting research. The indicias "P", "I", and "S" refer respectively to the influences of the physical, intellectual and sensitive cycles, to assist in the interpretation of the mixed biorhythmic periods.

As is known, each four year interval in our calendar includes one leap year, that is one year wherein the month of February has 29 days instead of 28 days. Thus, starting from the vertical line 18 representing birth and counting 365 days, the vertical line 29 will be reached and represent the entire first year of life for most individuals and three-fourths of the years, and the dashed reference line 30, which is one day spaced ahead from the reference line 29 will indicate 366 days, which would be the end of 1 year from birth if the first year from birth was a leap year. The indicia 28 is provided as numeral 1 between lines 29 and 30 to indicate the first birthday according to western calculations. Proceeding in the forward direction of the graph, and counting an additional 365 days from both lines 29 and 30, lines 33 and 32, respectively will be reached with an indicia mark 31 of numeral 2 representing the second birthday and being between such reference lines 33 and 32. For continuity, these same lines 32, 33 and indicia 31 are shown in FIG. 2. Continuing an additional 365 days, the third birthday represented by indicia 34 will be indicated by lines 35, 36 and similarly the fourth birthday, indicia 37, will be represented by reference line 39, which is not adjustable as are previous indicia, 34, 31 and 28, because the end of a 4 year period has been reached; that is every fourth birthday in this year is fixed.

Since each four year interval (the first 4 year interval from birth being represented in FIGS. 1 and 2) contains only a single leap year, that is a year having an extra day, it is seen that if: (1) the leap occurs in the first year from birth, the first year will extend vertical line 18 for 366 days to vertical line 30, the second year from birth will extend from vertical line 30 to vertical line 32, the third year from birth will extend from vertical line 32 to vertical line 35, and the fourth year from birth will extend from vertical line 35 to vertical line 38; (2) the leap occurs in the second year from birth, the first year from birth will extend from vertical line 18 to vertical line 29, the second year from birth will extend from vertical line 29 to vertical line 32, the third year from birth will extend from vertical line 32 to vertical line 35, and the fourth year from birth will extend from vertical line 35 to vertical line 38; (3) February 29th occurs in the third year from birth, the first year from birth will extend from vertical line 18 to vertical line 29, the second year of birth will extend from vertical line 29 to vertical line 33, the third year from birth will extend from vertical line 33 to vertical line 35, and the fourth year from birth will extend from vertical line 35 to vertical line 38; (4) the February 29th occurs in the fourth year from birth, the first year from birth will be measured from the vertical line 18 to the vertical line 29, the second year from birth will be measured from the vertical line 29 to the vertical line 33, the third year from birth will be measured from the vertical line 33 to the vertical line 36, and the fourth year from birth will be measured from the vertical line 36 to the vertical line 38. These four situations are the only possible situations that may be involved with respect to where the leap year will place Feburary 29th in the first 4 years from birth, and in all situtations it is noted that the first 4 years from birth ends at vertical line 38. Therefore, the second four years from birth may be started from vertical line 38 and not from vertical line 39, and plotted in a corresponding manner to the first 4 years so that the birthday indicias corresponding to indicias 28, 31, 34 and 37 will have corresponding pairs of vertical lines representing the shift of one day for leap year. In such a manner, the desired 100 year span may be divided up into four intervals, with each four year interval having compensation marks for February 29 and with respect to any one particular four year interval, compensation need only be made for one occurrence of February 29, regardless of how many leap years have occurred between such specific four year interval and the date of birth.

Figure 3:
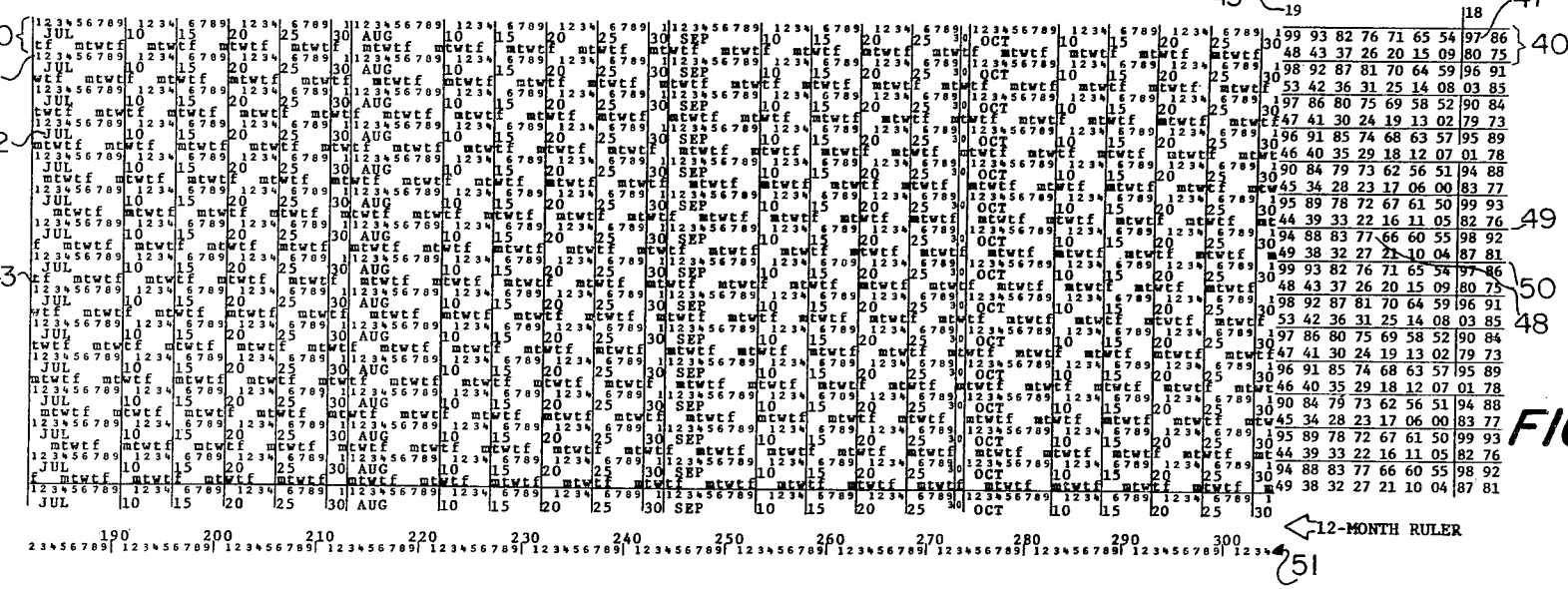
FIG. 3 shows a table correlating the days of some specific months with the days of the week for specific years.

FIG. 3 shows one of a plurality of similar tables that are employed with the present invention. The main left hand portion of the table includes a plurality of vertically spaced sets 40 of indicia, with each set including a horizontal row of numbers 41 representing the days of a month showing the first digit of the number for each day of the months represented, a horizontal row of indicia 42 giving an abbreviation for a specific month (such as JUL representing the month of July) and additionally a further representation as to the second digit of the numbers for the days (the second digit is expressed in the second horizontal line merely for convenience since there is insufficient room in the first line for such digits), and a third horizontal row of indicia showing abbreviations for the days of the weeks (for example in order "m" representing Monday, "t" representing Tuesday, "w" representing Wednesday, etc.). For the table shown in FIG. 3, the sets 40 of rows 41, 42, 43 represent the months of July, August, September and October, with the horizontal length of such representations corresponding exactly to the scale of the plot or graph of FIGS. 1 and 2, that is the space between adjacent day numbers in row 41 corresponds exactly to the space between vertical lines 13 representing the days in FIGS. 1 and 2.

Although the months of July, August, September and October contain the same number of days for each year, the day on which the various days of the week occur varies, that is Apr. 1, 1976 is a Thursday, Apr. 1, 1977 is a Friday, and Apr. 1, 1978 is a Saturday. While each of the groups 40 represents a specific year or could be used for a plurality of specific years, it is not readily seen which years are involved, and for this purpose, the right hand portion of the table in FIG. 3 is used for reference. The column 44 is employed for the years in the 20th century, such as 1977, while the column 46 is used for the years in the 19th century, for example 1896. To determine which of the groupings 40 is applicable for a particular year, the year is found in the right hand portion of the table shown in FIG. 3. For example, a scale or label containing a specific group 40 for the year 1993 would be the uppermost group 40 of the table, which could also be employed for the years 1999, 1982, 1976, 1971, 1965, 1954, 1897, 1886, 1948, 1943, 1937, 1926, 1920, 1915, 1909, 1880, and 1875. As a further example, the third grouping 40 from the top could be used for the years 1986, 1980, 1975, 1890, 1884, etc.

Although not shown, similar tables could be provided for the other months of the year, with the table including the month of February taking into consideration the presence or absence of February 29th according to whether or not there is a leap year.

Using the graph of FIGS. 1 and 2, which could be extended for any number of years, and using the table of FIG. 3, which can readily be extended to include the other months of the years, such graph and tables may be combined to produce a plot of the biorhythmic cycles in association with a calendar that is specific to a particular individual by merely knowing the individual's birthdate. Two illustrations of this will be shown in FIGS. 4 and 5.

Figure 4:
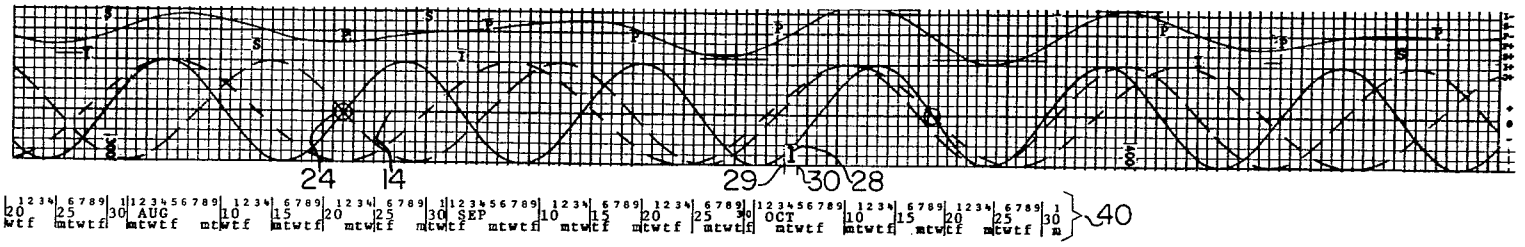
FIG. 4 shows a portion of the graph of FIG. 1 combined with a portion of table of FIG. 3.

In FIG. 4, a portion of the graph or plot shown in FIG. 1 that contains the indicia 28 for the first birthday has been individualized for a person having a birthday of Oct. 4, 1976. The tables could be cut up and employed from the birth reference line, which would be quite easy for a very young person, but for an older person it would be difficult and of little use to plot the biorhythmic cycles in the past since primarily it is the future and immediate past that is of interest. Therefore, the desired birthday within the period of interest is chosen, which in this example will be the first birthday occurring Oct. 4, 1977. With this information, the tables are reviewed to find the table containing the month of October, which in this case is the table shown in FIG. 3. Since 1977 occurs in the 20th century, the column 44 is chosen rather than the column 46 for further reference. The numeral 45 is combined with each of the numerals 47 to obtain the years in the column 44 until the year 1977 is located at 48. Next, the group 40 containing the year 1977 is separated from the remainder of the table by cutting along lines 49 and 50 in FIG. 3 to obtain a long strip of one each of rows 41, 42, 43; this strip is then placed along the bottom of the graph in FIG. 4. Since for the first year of birth, that is from Oct. 4, 1976 to Oct. 4, 1977, there was no February 29, this first year was only 365 days long rather than 366 days long, so that the mark 29 indicates the end of the first year from birth. Therefore, the indicia 4 representing Oct. 4, 1977 of the above mentioned strip is placed to the right of line 29 indicating the end of the first year of birth, to show that the first birthday as represented by indicia 28 occurs on Oct. 4. Transparent tape or adhesive is used to secure the calendar strip 40 in such position, it may be readily seen that additional calendar strips can be assembled consecutively quite easily after the first calendar strip has been located and secured. With the chart thus assembled for a particular individual, the theoretical influence of the three biorhythmic cycles may be easily determined for any particular day. For example, between Aug. 21 and Aug. 22, 1977, the physical cycle will cross the horizontal reference line 14 at the same time the sensitive cycle will cross the reference line 14, as indicated by the indicia 24 to provide a double critical day; at the same time, the intellectual cycle will be at its lowest point.

In the table of FIG. 3, the horizontal line 51 may be cut out and assembled either above or below the curves 10, 11, 12 to show the days of any particular year cumulatively as a further tool for evaluation.

Figure 5:
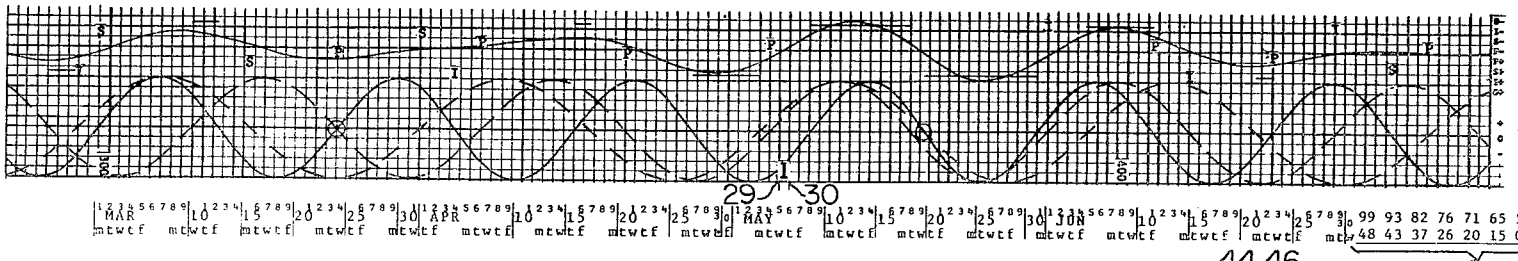
FIG. 5 shows the same portion of the graph of FIG. 1 that is shown in FIG. 4, but combined with a portion of the extension of the table of FIG. 3.

In FIG. 5, a chart has been constructed for a person born May 6, 1975, who would therefore have a first birthday on May 6, 1976. To assemble the chart, the tables are reviewed to locate the table containing the month of May, which would be a table similar to that shown in FIG. 3. Next, the columns 44, 46 of such table would be reviewed to obtain the row grouping 40 that corresponds to the year 1976, and when located the strip representing such a horizontal grouping will be separated from the table, and is shown in FIG. 5, wherein the corresponding portions of columns 44, 46 have been retained merely for purposes of illustration although it is understood that in using the assembled chart, this portion of the strip would be cut off and removed once it has served its purpose of identifying the strip. Between birth and the first birthday, there occurred Feb. 29, 1976, that is the first year from birth contained an extra day for total of 366 days and therefore such first year from birth ended at vertical reference line 30 rather than vertical reference line 29. Therefore, the first birthday of May 6, 1976 would appear to the right of vertical reference line 30 as shown in FIG. 5. In a like manner, additional strips containing additional months may be removed from the tables and assembled in order.

The four year interval shown in FIGS. 1 and 2 may appear on the same page, or adjacent pages as explained above, but preferably appears such that they may be considered generally in a common plane together. It is preferable that the curves 10, 11, 12 be indicated by lines that are distinct to such curves and different from each other as illustrated, and further variations are contemplated such as these lines may differ in width or color. Certainly other variations are possible.

With respect to interpreting the composite curve 26, there are provided eight symbols, namely: O−, I−, S−, P−, P+, S+, I+, and O+. These symbols represent the eight possible combinations of the three biorhythmic curves above or below the horizontal reference line for the curve 26. The symbols are coded to the initials of the three biorhythms so that "I−" means "the intellectual curve is minus (below the reference line) and the other two curves are plus." Similiarly, the "O−" means that "none of the biorhythmic curves are minus, that is they are all plus." The exact meanings of these eight configurations can be keyed to a separate chart, to give the best possible interpretations of overall biorhythmic conditions. "S−" means that the "sensitive curve is negative and the other curves are positive." "P−" means that the "the physical curve is negative and that the other curves are positive." "P+" means that "the physical curve is positive and the other curves are negative." "S+" means that the "sensitive curve is positive and the other curves are negative". "I+" means that "the intellectual curve is positive and that the other curves are negative". "O+" means that "none of the curves are positive and all of the curves are negative."

While a preferred embodiment of the present invention has been illustrated for desirability of its specific details and has a specific preferred example of the invention, further embodiments, modifications and variations are contemplated all according to the spirit and scope of the following claims.

What is claimed:

1. A device for use in indicating the three basic biorhythm cycles, of a physical cycle having a first fixed repeat pattern cycle starting from birth, a sensitive cycle having a second different fixed repeat pattern cycle starting from birth and an intellectual cycle having a third different fixed repeat pattern cycle starting from birth, all in correlation with a daily calendar for a specific birth date, comprising:

a first sheet of material having printed on only one surface a planar graph having a plurality of parallel vertical day lines with equal spaces therebetween representing a fixed multiple of a day, and a horizontal line representing average. biorhythmic tendencies;

a first curve fixed directly on said one surface starting from said horizontal line, extending above said horizontal line, returning to said horizontal line, extending below said horizontal line, and returning to said horizontal line in a fixed pattern of 23 days and thereafter serially repeating said pattern at regular intervals of 23 days of said vertical day lines to represent the physical biorhythmic cycle;

a second curve fixed directly on said one surface starting from said horizontal line, extending above said horizontal line, returning to said horizontal line, extending below said horizontal line, and returning to said horizontal line in a fixed pattern of 28 days and thereafter serially repeating said pattern at regular intervals of 28 days of said vertical lines to represent the sensitive biorhythmic cycle;

a third curve fixed directly on said one surface starting from said horizontal line, extending above said horizontal line, returning to said horizontal line, extending below said horizontal line, and returning to said horizontal line in a fixed pattern of 33 days and thereafter serially repeating said pattern at regular intervals of 33 days of said vertical lines to represent the intellectual biorhythmic cycle;

a plurality of birthday year markings fixed directly on said one surface, with said vertical lines and being numbered at year intervals of said vertical lines in order;

said birthday year markings, first curve, second curve and third curve all being fixed in a phase relationship such that if extended they would all start at the horizontal line and move upwardly at a common start vertical line representing birth; and a second sheet of material having printed on only one surface, a table of numbered days at a spacing corresponding to the spacing of said vertical lines and consecutively arranged and labeled according to the months of the calendar year, so that the table may be vertically aligned with the graph adjacent the curves in a position such that a birthdate represented by a day and month indication of the table may be vertically aligned with the corresponding birthday year marking on said graph vertically spaced adjacent the curves.

2. the device of claim 1, including a fourth curve fixed directly on said one surface of said first sheet vertically spaced from said first, second, and third curves and being a composite of said first, second and third curves that is in phase with the three curves of which it is a composite.

3. The device of claim 1, wherein said first curve is represented by a line that is physically distinct and consistent for the length of said first curve, said second curve is represented by a line that is physically distinct from the line of said first curve and consistent for the length of said second curve, and said third curve is represented by a line that is physically distinct from the lines representing the other curves and being consistent throughout the length of said third curve.

4. The device of claim 1, including a plurality of total day indicia spaced at corresponding points along said chart, each associated with the vertical line representing the number of days from the common start of said curves.

5. The device of claim 1, wherein said graph is long enough to represent a 4 year interval having therein one leap year and three of said birthday year markings, each of said birthday year markings being associated with two adjacent vertical lines having a space therebetween representing a one day potential shift of the birthday anniversary date according to whether February 29 occurred before or after the birthday anniversary date for the 4 year span, so that an element of said table containing the actual birthday identifying indicia may be aligned with one of said two lines if February 29 occurred before and with the other of two said adjacent vertical lines if February 29 occurred after.

6. The device of claim 5, wherein said graph representing a four year interval is arranged on a single planar surface of an opened bound book, and a plurality of such charts, each of consecutive four year intervals beginning with the common start vertical line representing birth being respectively on corresponding planar surfaces of said book.

7. The device of claim 6, wherein the end vertical line for each four year interval is shifted one extra day with respect to the beginning line to compensate for the leap year between said beginning and end lines of each four year interval, so that for any one chart containing four years only a single one day shift is needed to compensate for leap year irrespective of the total number of leap years that have occurred between the common start representing birth and the particular four year interval.

8. The device of claim 7, wherein said planar surfaces having thereon said charts are separate from said table.

9. The device of claim 6, wherein said planar surfaces having thereon said charts are separate from said table.

10. The device of claim 1, wherein said table has a serial array of the day of the week indications vertically aligned with the horizontal row of numbered days for a specific year and having adjacent thereto indicia representing such specific year for which the day of the week indicia and day of the month indicias are aligned properly.

11. The device of claim 1, including a fourth curve fixed directly on said one surface of said first sheet vertically spaced from said first, second, and third curves and being a composite of said first, second and third curves, that is in phase with the three curves of which it is a composite; and eight different indicia made up of separate indicia representing the three biorhythmic curves, a plus sign, a negative sign, and indicia representing the absence or summation of all the curves in combination serially along said composite curve to correspondingly indicate which of said basic biorhythmic curves are negative and which of said basic three biorthymic curves are positive along said composite curve.

* * * * *